US006619925B2

(12) United States Patent
Ohkawa

(10) Patent No.: US 6,619,925 B2
(45) Date of Patent: Sep. 16, 2003

(54) FIBER FILLED ELECTRO-OSMOTIC PUMP

(75) Inventor: Tihiro Ohkawa, La Jolla, CA (US)

(73) Assignee: Toyo Technologies, Inc., La Jolla, CA (US)

( * ) Notice: Subject to any disclaimer, the term of this patent is extended or adjusted under 35 U.S.C. 154(b) by 123 days.

(21) Appl. No.: 09/972,518

(22) Filed: Oct. 5, 2001

(65) Prior Publication Data

US 2003/0068229 A1 Apr. 10, 2003

(51) Int. Cl.[7] ..... F04F 11/00
(52) U.S. Cl. ..... 417/48; 204/600; 604/151
(58) Field of Search ..... 417/48, 50, 53; 204/600, 603; 604/151

(56) References Cited

U.S. PATENT DOCUMENTS 3,505,634 A 4/1970 Von Vick
3,923,426 A * 12/1975 Theeuwes ..... 417/48
4,309,908 A 1/1982 Rapp et al.
5,632,876 A * 5/1997 Zanzucchi et al. ..... 204/600
2002/0070116 A1 * 6/2002 Ohkawa ..... 204/603

* cited by examiner

*Primary Examiner*—Charles G. Freay
*Assistant Examiner*—John Belena
(74) *Attorney, Agent, or Firm*—Nydegger & Associates

(57) ABSTRACT

An electro-osmotic pump, for transporting aqueous solutions in micro-fluidics, has a tubular-shaped pumping section which includes a pump tube that is connected in fluid communication with an extension tube. A thread of silica fibers is positioned in the lumen of the pump tube, and an aqueous solution that will interact with the thread is introduced into the pump tube lumen to charge the aqueous solution. In operation, a voltage potential is selectively applied between the pump tube and the extension tube to establish a ground-potential-ground electric field along the pumping section. This creates a force on the charged aqueous solution that moves it through the pump tube and, consequently, also moves fluid through the extension tube. Various embodiments of the electro-osmotic pump are envisioned, including the serial connection of several pumping sections, for use as valves, switches or pumps.

20 Claims, 2 Drawing Sheets

FIBER FILLED ELECTRO-OSMOTIC PUMP

FIELD OF THE INVENTION

The present invention pertains generally to fluid pumps. More particularly, the present invention pertains to electro-osmotic pumps that are useful for transporting aqueous solutions in micro-fluidics. The present invention is particularly, but not exclusively, useful as a device and method for improving the pumping capacity of electro-osmotic pumps.

BACKGROUND OF THE INVENTION

It is well known that a liquid can be moved through a small diameter tube under the influence of an applied electric field by a phenomenon that is commonly known as the electro-osmotic (EO) effect. Specifically, the EO effect arises from the fact that when an aqueous solution comes into contact with certain active materials (either acidic or caustic), the solution becomes, charged. If an acidic active material is used, such as silica, the solution becomes positively charged. On the other hand, if a caustic material is used, the solution becomes negatively charged. In either case, the application of an electric field on the charged solution will generate forces on the solution that cause it to move.

It happens with the EO effect that only a very thin layer of the solution that is in direct contact with the active material will become charged. Typically, this layer of charged solution will have a very shallow depth that is approximately equal to the Debye length (e.g. 10 nm). The consequence of this is that only a relatively small volume of the solution can be charged by the EO effect. Nevertheless, despite the small volume of charged solution, in order to be effective in moving an aqueous solution through a tube, the forces that are generated on the charged solution by an applied electric field must somehow overcome the pressure head in the tube.

For micro-fluidics applications it is well known that the EO effect can be usefully employed, but with some significant limitations. Most noticeably, these limitations involve the size of the tubes that can be used, and the magnitude of the electric field that can be used to drive the charged aqueous solution through the tube. Specifically, insofar as the electric field is concerned, high current densities for generating this electric field are undesirable for at least two reasons. First, high current densities can cause excessive ohmic heating of the solution in the tube. Second, the high current densities at the electrodes that generate the electric field may evolve gases in the tube due to the electrolysis of water. This, in turn, will disrupt the electric field. Insofar as the size of the tubes is concerned, the pressure head in the tube that resists the movement of liquid through the tube is of paramount importance. Heretofore, for the EO effect to be useful in overcoming pressure head, small diameter tubes have been required (typically the radius must be less than 10–20 microns). With this in mind, a mathematical analysis of the EO effect, and its interaction with the resistive pressure head in the tube, is instructive.

For an example of conventional flow in a tube due to the EO effect, in resistance to a pressure head, consider a tube which is made of an EO active material, such as silica, and which has a lumen of radius "a".

The bulk flow velocity of the EO flow that is driven by an electric field, within a thin layer near the wall of the tube, is given by $$u=\lambda\Sigma V/2\eta L$$

where $\lambda$ is the layer thickness (typically 10 nm), $\Sigma$ is the wall surface charge density (typically $10^{-2}$ Coulomb/m$^2$), V is the voltage, $\eta$is the absolute viscosity absolute viscosity of the fluid and L is the length of the tube. The velocity can be written in terms of zeta potential $\zeta$ defined as $$\zeta=\lambda\Sigma/\in$$

where $\in$ is the dielectric constant of the fluid.

The Poiseille flow which is driven by the pressure head, and which resists the EO flow described above, has a parabolic velocity profile given by $$v=u-[pa^2/4L\eta][I-r^2/a^2]$$

where p is the pressure head, and where a value for a >>$\lambda$ is assumed. Under these conditions, total flow discharged role in the tube is given by $$\Gamma=\int_0^a 2\pi v\ r\ dr=\pi a^2\{u-pa^2/[8L\eta]\}.$$

The condition that the EO drive overcomes the pressure head is then given by $$a^2<4\lambda\Sigma V/p.$$

From the above expression it will be appreciated that when a large pressure head is desirable, the radius of the tube "a" must be quite small. The consequence is a very small throughput. The optimal radius with other parameters fixed is given by $$a^2=2\lambda\Sigma V/p$$

and the total flow becomes $$\Gamma=\pi a^2 u/2.$$

From the above expression, it is to be appreciated that the electro-osmotic (EO) effect is a surface effect. As such, the EO effect is significantly dependent on the amount of surface area of the active material that is exposed to the aqueous solution.

In light of the above, it is an object of the present invention to provide a tubular shaped electro-osmotic pump for pumping an aqueous solution which effectively increases the amount of active material surface area that is exposed to the solution per length of tubing used. Another object of the present invention is to provide a tubular shaped electro-osmotic pump which can effectively employ lumens of increased cross sectional areas. Yet another object of the present invention is to provide an electro-osmotic pump which has increased efficiency with little or no increase in voltage requirements in order to avoid ohmic heating of the pump and the unwanted evolution of gas due to electrolysis. Still another object of the present invention is to provide an electro-osmotic pump that can be variously used as a switch or a valve, as well as a pump. Another object of the present invention is to provide an electro-osmotic pump that can effectively incorporate a trapped air isolator which will prevent clogging of the active element of the pump, and maintain low electrical conductivity. Also, it is an object of the present invention to provide an electro-osmotic pump that is relatively simple to manufacture, is easy to use, and is comparatively cost effective.

SUMMARY OF THE PREFERRED EMBODIMENTS

The electro-osmotic pump of the present invention provides structure which significantly increases the interface surface area between an active element (e.g. silica fibers) and an aqueous solution in which the active element is submerged. Consequently, more of the aqueous solution can be charged by the active element, and a lower electric field charge is effective for generating a pumping force on the solution.

In accordance with the present invention, a container is provided for holding an active element in an aqueous solution. Preferably, the container is tube-shaped and has a lumen which defines an axis that extends from one end of the tube to the other. In the preferred embodiment of the present invention, the active element will include a plurality of fibers that are spun together into a thread. This thread is then positioned inside the lumen of the tube-shaped container to create a pump tube. Importantly, the thread will extend between the ends of the pump tube with the fibers of the thread aligned substantially parallel to the axis of the pump tube. The lumen of the pump tube is then filled with an aqueous solution that will interact with the thread to charge the aqueous solution. As envisioned for the present invention, the cross sectional area of the pump tube lumen, taken in a plane perpendicular to the axis of the pump tube, will have an area equal to "A", while the collective cross sectional areas of the fibers in the thread in this plane will be equal to approximately one half of "A" (i.e. A/2).

In order to create an electric field in the lumen of the pump tube, electrodes are positioned at each end of the pump tube. Preferably, one of these electrodes will have a zero potential while the other electrode has either a negative or a positive potential and the resultant electric field will be oriented substantially parallel to the axis of the pump tube. Accordingly, whenever an electric field is applied to the pump tube, a force will be created on the charged aqueous solution that will move the aqueous solution through the pump tube.

In combination, an extension tube can be connected in fluid communication to one end of the pump tube. Importantly, depending on whether the extension tube is connected to a voltage potential V or zero potential (ground) at the end of the pump tube, the extension tube will respectively return from a zero potential (ground) to the voltage potential V or vice versa. Together, a pump tube and the extension tube will then define a pumping section for the electro-osmotic pump of the present invention. Further, in order to increase the pumping force of the electro-osmotic pump, a plurality of these pumping sections can be serially joined together with an alternation between pump tubes and extension tubes. Importantly, because voltages can be applied in parallel to the serially connected pumping sections, there is no requirement for using higher voltages.

An important option for the present invention involves the extension tube. For one embodiment, the extension tube can be filled with the aqueous solution. This, however, is not a requirement. Specifically, for situations wherein it may be desirable to pump a fluid other than the aqueous solution, the extension tube may be at least partially filled with an air bubble. The air bubble will then isolate the aqueous solution and thread in the pump tube from whatever different fluid is in the extension tube and is being pumped by a pumping section. Other options for the present invention involve various orientations for the pump and extension tubes, as well as changes in their respective cross sectional areas. As envisioned for the present invention, these various orientations and changes can allow the electro-osmotic pump of the present invention to be used as a valve or a switch in addition to its more conventional use as a pump.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
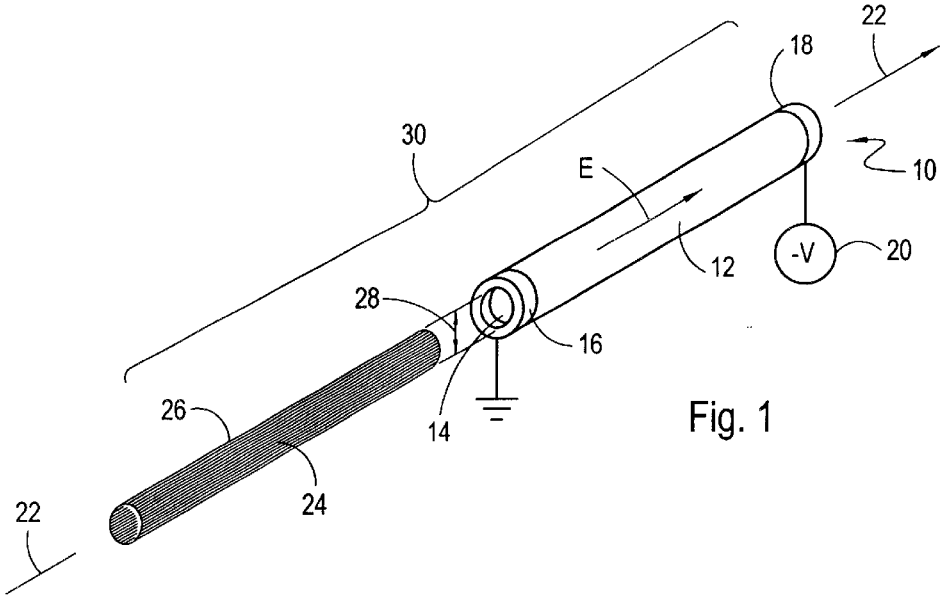
FIG. 1 is an exploded perspective view of an electro-osmotic pump according to the present invention, showing a thread of active material before it is positioned inside the lumen of a pump tube.

Referring initially to FIG. 1, an exploded view of an electro-osmotic (EO) pump in accordance with the present invention is shown and is generally designated 10. Specifically, the EO pump 10 includes a container, such as the elongated tube 12 shown in FIG. 1. For purposes of the present invention, the tube 12 is formed with a lumen 14 and has an electrode 16 that is attached to, or mounted at, one end of the tube 12. The tube 12 will also have an electrode 18 that is attached to, or mounted at, the other end of the tube 12, opposite the electrode 16. One of these electrodes (e.g. electrode 16) is grounded, while the other electrode (e.g. electrode 18) is connected to a voltage source 20. With this structure, a voltage potential can be placed on the electrode 18 that will create an electric field, E, in the lumen 14 of tube 12. Importantly, the electric field, E, will be generally oriented in a direction that is parallel to the axis 22 of the tube 12.

Still referring to FIG. 1, it is seen that the EO pump 10 of the present invention includes a thread 24 that is spun from a plurality of individual fibers 26. Preferably, the fibers 26 are made of silica, or of some other active material well known in the pertinent art, which, when in contact with an aqueous solution, will develop a charge in the aqueous solution. Regardless of what active material is used for the thread 24, for the EO pump 10 of the present invention, it is envisioned that the diameter 28 of the thread 24 will be substantially the same as the diameter of lumen 14 of the elongated tube 12. Also, the length of the thread 24 will be substantially the same as the length of the tube 12. Thus, as implied in FIG. 1, the thread 24 can be inserted into the lumen 14 of tube 12 and positioned therein between the electrodes 16 and 18. In combination, when the thread 24 is positioned in lumen 14 of tube 12, these components of the EO pump 10 establish a pump tube 30.

Figure 2:
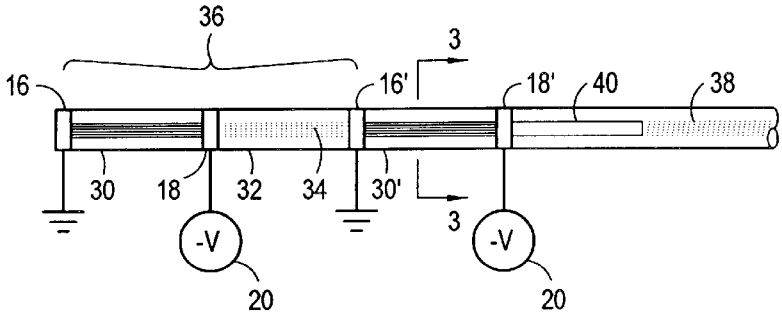
FIG. 2 is a side elevation view of a preferred embodiment of the electro-osmotic pump of the present invention which incorporates a plurality of end-to-end pumping sections.

Referring to FIG. 2, it will be seen that the present invention envisions joining a pump tube 30 in fluid communication with an extension tube 32. For a combination of pump tube 30 and extension tube 32, such as shown in FIG. 2, an aqueous solution 34 will fill both the pump tube 30 and the extension tube 32, and they will have a common electrode (e.g. electrode 18). Note that at the end of the extension tube 32, which is opposite the common electrode 18, another grounded electrode 16' can be used. Together, in this combination, the tubes 30 and 32 establish a pumping section 36. As intended for the present invention, a pumping section 36 can be used by itself. Also, a pumping section 36 can be positioned end-to-end with other pumping sections 36 in an alternation that will position grounded electrodes (e.g. electrodes 16) between voltage sources 20 (e.g. electrodes 18). In this manner, pumping sections 36 can be serially aligned to increase their pumping pressure head without requiring additional voltage.

Still referring to FIG. 2, it is to be appreciated that the present invention contemplates an EO pump 10 which is effective for pumping a liquid 38 other than the aqueous solution 34 that is necessary for creating the EO effect. In particular, it can happen that it may be necessary to pump a liquid 38 (e.g. blood) which would tend to clog the thread 24 if they were ever to come into contact with each other. For such situations, the present invention envisions creating an air bubble 40 in the extension tube 32 that will effectively isolate the thread 24 and aqueous solution 34 from the different liquid 38. It can be shown mathematically, that pressures created by the EO effect in a pump tube 30 on the aqueous solution 34 are effectively transmitted to the different liquid 38 through the air bubble 40. With this in mind, the importance of the present invention is to increase the pressures that can be created in the pump tube 30 by the EO effect.

Figure 3:
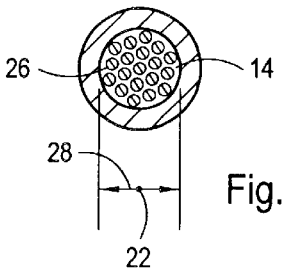
FIG. 3 is a cross-sectional view of a pump tube as seen along the line 3—3 in FIG. 2.

It is interesting to note that for a lumen 14 having a cross sectional area of a value "A" in a plane perpendicular to the axis 22, as shown in FIG. 3, the collective cross sectional areas of the fibers 26 in this same plane will be equal to approximately "A/2". Mathematically, the consequence of this relationship on the resultant EO effect is significant. For example, consider the situation wherein a thread 24 is placed in the tight fitting tube 12. The number of fibers N in the thread 24 satisfies the expression $$N=b^2/[2a^2]$$

where the diameter 28 of lumen 14 is equal to a value of "2b" (i.e. the radius is "b") and the individual fibers 26 each have a radius "a". The volume of the microchannels between the fibers 26 in the thread 24 will then be approximately equal to the volume of the fibers 26. Thus, the channels will collectively behave as tubes which have the radius "a" on the average. The total flow through the tube 12 is then given by $$\Gamma=[\pi b^2/2]\{u-pa^2/[8L\eta]\}$$

where p is pressure head, L is the length of tube 12 and $\eta$ is the absolute viscosity of the fluid in the tube 12. For the condition where the EO drive balance the pressure head, p, this equation shows that the pressure head is one of the factors determining the radius "a" of the fibers, the throughput, $\Gamma$, is governed by the tube diameter 28. Thus, even with large pressure head, p, large throughputs become possible when the number of fibers N is large.

Figure 4:
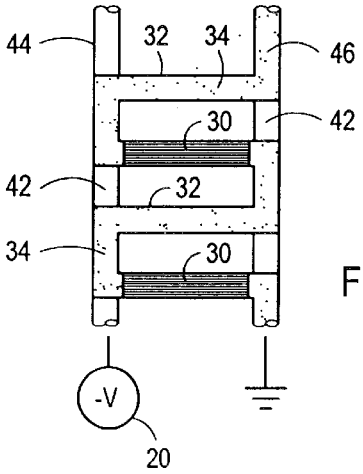
FIG. 4 is a plan view of an alternate embodiment of the present invention.
Figure 5:
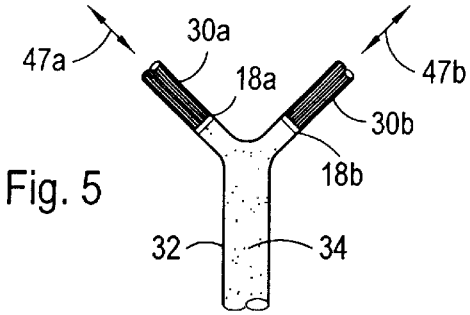
FIG. 5 is a plan view of an alternate embodiment of the present invention which is useful as a valve or switch.

Several variations are envisioned by the present invention for the structure for pumping sections 36, and for the combined incorporation of several pumping sections 36 into a single EO pump 10. For one, as shown in FIG. 4, the pumping sections 36 can be arranged in a ladder-like structure. Such a structure will effectively decrease the overall length of serially connected pumping sections 36. More specifically, in a general ladder-like arrangement as shown in FIG. 4, a series of parallel pump tubes 30 can be alternated between a series of mutually parallel extension tubes 32. In this arrangement, partitions 42 will need to be employed as shown to separate sequential extension tubes 32 from each other. The legs 44 and 46 of the ladder-like arrangement can then be respectively used as electrodes 18 (connected to voltage source 20) and electrodes 16 (grounded). In another combination, shown in FIG. 5, one pump tube **30*a* can be connected with another pump tube 30*b* to establish two legs of a Y-shaped conduit. In this combination, the base of the conduit can then be established as an extension tube 32. Then, depending on how voltage potentials are applied to the respective electrodes 18*a* and 18*b* of pump tubes 30*a* and 30*b*, the aqueous solution 34 can be selectively driven in the directions indicated by the arrows 47*a* and 47*b***.

Figure 6:
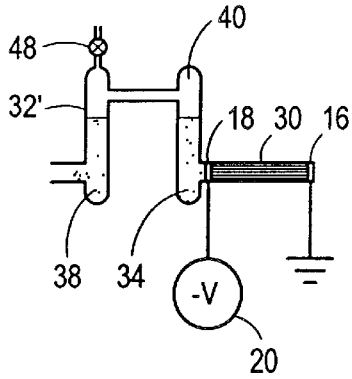
FIG. 6 is an elevation view of an air isolator that can be incorporated into the electro-osmotic pump of the present invention.

An alternative embodiment for the structure of an EO pump 10 which incorporates an air bubble 40 is shown in FIG. 6. For this embodiment, it is seen that a valve 48 is associated with that portion of extension tube 32' where the air bubble 40 is to be located. The air bubble 40 can then be injected into the extension tube 32' through the valve 48. Subsequently, the air bubble 40 can be regulated and controlled by the valve 48. Alternatively, and more particularly for a linear EO pump 10 as shown in FIG. 2, the air bubble 40 can be located in the extension tube 32 by using a syringe type instrument (not shown).

Figure 7:
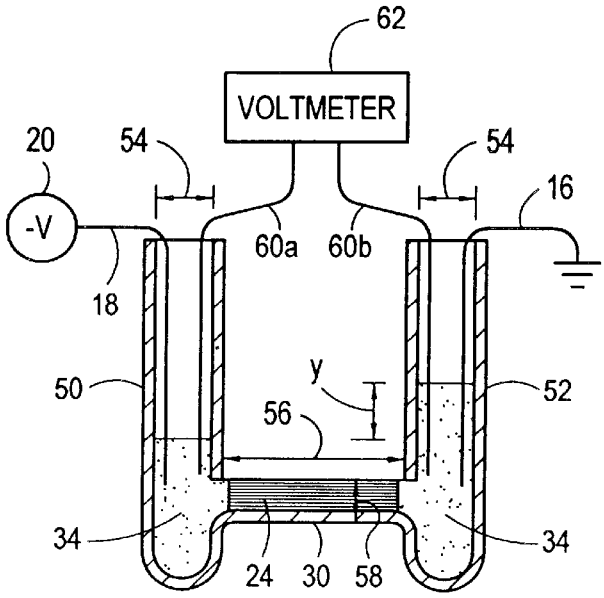
FIG. 7 is an experimental set-up for testing the efficacy of the present invention.

The efficacy of the present invention can be demonstrated using a test set-up such as the one shown in FIG. 7. In this set-up, two substantially parallel, vertically-oriented reservoirs 50 and 52 are connected to each other via a pump tube 30. Each reservoir 50, 52 has an inner diameter 54 that is fifteen millimeters (15 mm), and the pump tube 30 has a length 56 that is five centimeters (5 cm) and an inner diameter 58 that is three millimeters (3 mm). The thread 24 in the pump tube 30 is spun from silica fibers that are approximately five microns in diameter (5 $\mu$m). For experimental (demonstration) purposes, the electrodes 16 and 18 can be platinum wires that are placed in the aqueous solution 34 in the reservoirs 50, 52. As discussed above, this arrangement will establish a voltage potential between the voltage source 20 and ground that will create an electric field, E, in the pump tube 30. Electrodes **60*a* and 60*b* can then be inserted into the reservoirs 50, 52 and connected with a voltmeter 62** to measure the electric field, E.

To test the EO effect of the set-up shown in FIG. 7, the pump tube 30 and the reservoirs 50, 52 are filled with de-ionized water (aqueous solution 34). After the water levels of the reservoirs 50, 52 settle down to equal level, the voltage source 20 is turned on. The water level difference between two reservoirs 50, 52 is then measured as a function of time.

According to the theoretical analysis, the water level difference y should behave $$y=y_0\{1-\exp[-t/\tau]\} \quad [1]$$

where $y_0=4\lambda\Sigma V/[a^2\rho g]$ $\tau^{-1}32\ b^2a^2\rho g/[16\ R^2\eta L]$ the experimental data are used to obtain the values of $y_0$ and $\tau$ from eq. [1] above. An example set of values are: $y_0$=4.82 cm and $\tau=3.48=10^4$ sec. By using the experimental parameters: V=65 volt, b=1.5 mm, R×7.5 mm, L=5 cm, $\eta=10^{-3}$ kg/m s and $\rho g=10^4$ hg/m$^2$s$^2$, we obtain $\lambda\Sigma=1.1\times10^{-10}$ Coulomb/m $\zeta=\lambda\Sigma/\in=155$ mV $a=7.5\times10^{-6}$ m $\Sigma g\ y_0/V=7.5$ pascal/volt.

The values of $\lambda$, $\Sigma$ and $\zeta$ are reasonable for silica. The effective channel radius "a" is also reasonable considering the fact that the viscous flow is weighted by $a^4$ while the area is weighted by $a^2$. There is, however, some statistical distribution of the channel radius in the thread 24 and the value of the effective radius of pump tube 30 should be larger than the value estimated from its area.

Experiments have shown that the pressure head equivalent of an ordinary tube with 5 micron radius is obtained with the pump tube 30 with 7.5 mm radius. Also, the volume flow of the pump tube 30 is $b^2/2a^2=2\times10^4$ times greater compared to a single ordinary tube of radius "a". Thus, the experimental results confirm that a pump tube 30 can generate a high pressure head and a large volume flow simultaneously.

While the particular Fiber Filled Electro-Osmotic Pump as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An electro-osmotic pump which comprises:

a pump tube having a first end and a second end with a lumen extending therebetween, said pump tube defining an axis and said lumen having a cross sectional area perpendicular to said axis equal to "A";

a plurality of elongated fibers positioned in said lumen of said pump tube between said first end and said second end, with said fibers having a collective cross sectional area perpendicular to said axis equal to approximately "A/2";

an aqueous solution filling said lumen between said first end and said second end of said pump tube to interact with said fibers to charge said solution; and a means for generating an electric field between said first end and said second end of said pump tube to create a force on said charged solution to move said charged solution in said lumen.

2. A pump as recited in claim 1 wherein said elongated fibers are spun together to create a thread.

3. A pump as recited in claim 1 further comprising an extension tube having a lumen, said extension tube being connected to said second end of said pump tube with said lumen of said extension tube in fluid communication with said lumen of said pump tube.

4. A pump as recited in claim 3 wherein said lumen of said extension tube is at least partially filled with an air bubble.

5. A pump as recited in claim 3 wherein said extension tube defines an axis and said axis of said extension tube is substantially parallel to said axis of said pump tube.

6. A pump as recited in claim 3 wherein said second end of said pump tube has a voltage potential V and wherein said voltage potential V drops to a zero potential along said extension tube.

7. A pump as recited in claim 3 wherein said pump tube and said extension tube define a pumping section and said electro-osmotic pump comprises a plurality of said pumping sections serially joined together with an alternation between said pump tubes and said extension tubes.

8. A pump as recited in claim 1 wherein said fibers are made of silica.

9. A pump as recited in claim 1 wherein said electric field in said pump tube is oriented substantially parallel to said axis between said first end and said second end.

10. An electro-osmotic pump which comprises:

a container defining an axis;

an aqueous solution filling said container;

a plurality of elongated fibers submerged in said aqueous solution for interaction therebetween to charge said aqueous solution, said plurality of fibers being aligned substantially parallel to said axis; and a voltage means connected to said container to create an axially oriented electric field therein to generate a force on said charged aqueous solution for axial movement thereof relative to said container.

11. A pump as recited in claim 10 wherein said container is a pump tube having a first end and a second end with a lumen extending therebetween along said axis, wherein said lumen has a cross sectional area perpendicular to said axis equal to "A", and further wherein said plurality of elongated fibers are spun together to create a thread having a collective cross sectional area perpendicular to said axis equal to approximately "A/2".

12. A pump as recited in claim 11 wherein said electric field is oriented substantially parallel to said axis between said first end and said second end and has a substantially zero voltage potential at said first end of said pump tube and a voltage potential V at said second end thereof.

13. A pump as recited in claim 12 further comprising an extension tube having a lumen, said extension tube being connected to said second end of said pump tube with said lumen of said extension tube in fluid communication with said lumen of said pump tube to establish a pumping section and wherein said voltage potential V drops to a zero potential along said extension tube.

14. A pump as recited in claim 13 further comprising a plurality of said pumping sections with said pumping sections being serially connected to each other with an alternation between said pump tubes and said extension tubes.

15. A pump as recited in claim 13 wherein said lumen of said extension tube is at least partially filled with an air bubble.

16. A method for manufacturing an electro-osmotic pump which comprises the steps of:

providing a container defining an axis;

positioning a plurality of elongated fibers in said container with said plurality of fibers aligned substantially parallel to said axis;

filling said container with an aqueous solution to establish an interaction between said aqueous solution and said fibers to charge said aqueous solution; and applying a voltage to said container to create an axially oriented electric field therein to generate a force on said charged aqueous solution for axial movement thereof relative to said container.

17. A method as recited in claim 16 further comprising the steps of:

forming said container as a pump tube having a first end and a second end with a lumen extending therebetween, said pump tube defining an axis and said lumen having a cross sectional area perpendicular to said axis equal to "A"; and spinning said plurality of elongated fibers together to create a thread, said thread being positioned in said lumen of said pump tube between said first end and said second end, with said fibers in said thread having a collective cross sectional area perpendicular to said axis equal to approximately "A/2".

18. A method as recited in claim 17 wherein said electric field is oriented substantially parallel to said axis between said first end and said second end and has a substantially zero voltage potential at said first end of said pump tube and a voltage potential V at said second end thereof.

19. A method as recited in claim 18 further comprising the steps of:

connecting an extension tube having a lumen to said second end of said pump tube with said lumen of said extension tube in fluid communication with said lumen of said pump tube to define a pumping section and to drop said voltage potential V to a zero potential along said extension tube; and joining a plurality of said pumping sections serially together with an alternation between said pump tubes and said extension tubes.

20. A method as recited in claim 19 wherein said thread is made of silica fibers and said method further comprises the step of at least partially filling said extension tube with an air bubble.

* * * * *

UNITED STATES PATENT AND TRADEMARK OFFICE

CERTIFICATE OF CORRECTION

PATENT NO. : 6,619,925 B2
DATED : September 16, 2003
INVENTOR(S) : Tihiro Ohkawa It is certified that error appears in the above-identified patent and that said Letters Patent is hereby corrected as shown below:

Column 2,
Line 4, delete "absolute viscosity absolute viscosity" insert -- absolute viscosity --
Line 19, delete "role" insert -- rate --
Line 29, delete "tube is" insert -- tube Γ is --

Column 6,
Line 57, delete "32" insert -- = --
Line 60, delete "$3.48=10^4$" insert -- $3.48x10^4$ --
Line 61, delete "Rx7.5" insert -- R=7.5 --
Line 67, delete "Σg" insert -- ρg --

Signed and Sealed this

Thirteenth Day of January, 2004

JON W. DUDAS
*Acting Director of the United States Patent and Trademark Office*